US010823534B1

(12) United States Patent
Johnson, Sr.

(10) Patent No.: US 10,823,534 B1
(45) Date of Patent: Nov. 3, 2020

(54) SYSTEM AND DEVICE FOR PERSONAL SHIELDING

(71) Applicant: Tommy J. Johnson, Sr., Virginia Beach, VA (US)

(72) Inventor: Tommy J. Johnson, Sr., Virginia Beach, VA (US)

( * ) Notice: Subject to any disclaimer, the term of this patent is extended or adjusted under 35 U.S.C. 154(b) by 0 days.

(21) Appl. No.: 16/427,757

(22) Filed: May 31, 2019

Related U.S. Application Data

(60) Provisional application No. 62/679,225, filed on Jun. 1, 2018.

(51) Int. Cl.

| | |
|---|---|
| ***F41H 5/08*** | (2006.01) |
| ***G08B 21/18*** | (2006.01) |
| ***G08B 3/10*** | (2006.01) |
| *F41H 5/04* | (2006.01) |

(52) U.S. Cl.
CPC ..... *F41H 5/08* (2013.01); *G08B 3/10* (2013.01); *G08B 21/18* (2013.01); *F41H 5/0421* (2013.01); *F41H 5/0457* (2013.01)

(58) Field of Classification Search
CPC ... F41H 5/08; F41H 1/00; F41H 13/00; A47F 7/00; A47F 7/0042
See application file for complete search history.

(56) References Cited

U.S. PATENT DOCUMENTS

| | | | |
|---|---|---|---|
| 1,619,982 A | 3/1927 | Lucas | |
| 6,349,201 B1 | 2/2002 | Ford | |
| 8,154,844 B2 | 4/2012 | Brown | |
| 9,010,231 B1 | 4/2015 | Cohn | |
| 9,090,116 B2 | 7/2015 | Tunis et al. | |
| 9,726,458 B2 | 8/2017 | Weekly | |
| 9,982,968 B2 | 5/2018 | Thomas | |
| 9,982,969 B2 * | 5/2018 | Klingman | B60R 21/12 |

(Continued)

FOREIGN PATENT DOCUMENTS

EP 3272245 A1 1/2018

OTHER PUBLICATIONS

Malafronte, Katie, "Armor at Hand Announces New, Hidden In-Plain-Sight IoT Shields," retrieved from campussafetymagazine.com/safety/armor-at-hand-shields/ on Mar. 26, 2019.

(Continued)

*Primary Examiner* — J. Woodrow Eldred
(74) *Attorney, Agent, or Firm* — F. Michael Sajovec; Douglas C. Tsao; Williams Mullen

(57) ABSTRACT

A system and device for providing bullet proof protection to persons is described. A pre-staged shield, possibly wall mounted, that is capable of shielding the head and torso, for example, may be provided in a vulnerable facility. An optional and distinct alert system may be activated when the shield is removed from its location, whether seated on the wall, mount, or container such as a storage locker. Such alert system may be triggered by a switch, such as a pressure sensing seat in communication with a loudspeaker and alarm or monitoring system. When an alarm is activated, an optional distinct alert is sounded within the facility and the monitoring system may alert law enforcement and emergency first responders of the active shooter location. Such a shield and system may permit an unarmed, unprepared person to have the opportunity to shield themselves.

18 Claims, 12 Drawing Sheets

(56) References Cited

U.S. PATENT DOCUMENTS

| | | | | |
|---|---|---|---|---|
| 10,480,907 | B2 | 11/2019 | Klassen | |
| 2008/0178781 | A1 | 7/2008 | Kim | |
| 2009/0132098 | A1 | 5/2009 | Leshem | |
| 2014/0251122 | A1* | 9/2014 | Adams | F41H 5/08 89/36.07 |
| 2018/0372455 | A1* | 12/2018 | Klassen | F41H 5/013 |

OTHER PUBLICATIONS

"The SmartBoot Building Safety and School Lockdown System," retrieved from lockoutusa.com/products/smart-boot-system/ on Mar. 26, 2019.

"Emergency Response Shield Active Shooter Protection," retrieved from hardwirellc.com/collections/school-office/products/emergency-response-shield on Mar. 27, 2019.

Edwards United Technologies (2015), "Low Frequency Emergency Signaling Handbook,a practical guide to compliance and its history,".

"Chapter 6, Auditory, Tactual, and Olfactory Displays." Part 2: Information Input. pp. 140-172.

"Chapter 7, Speech Communications," Part 2: Information Input, pp. 173-193.

"Small Ballistic Shield," Mars Armor, retrieved from www.marsarmor.com, retrieved on May 30, 2019.

"7.5 Pulse-Code Modulation (PCM)," Pulse-Code Modulation (PCM), pp. 356-366.

Feix, Thomas et al., "The GRASP Taxonomy of Human Grasp Types," The GRASP Taxonomy of Human Grasp Types, pp. 1-12.

"Chapter 11: Tools and Devices," Part 3: Human Output and Control, pp. 309-317.

"Understanding NIJ 0101.06 Armor Protection Levels," Justice Technology Information Center/National Institute of Justice, retrieved from www.justnet.org, retrieved on May 24, 2019.

* cited by examiner

SYSTEM AND DEVICE FOR PERSONAL SHIELDING

CROSS-REFERENCE TO RELATED APPLICATIONS

This application claims the benefit of priority to U.S. Provisional Patent Application No. 62/679,225, filed Jun. 1, 2018.

STATEMENT REGARDING FEDERALLY SPONSORED RESEARCH OR DEVELOPMENT

Not Applicable

FIELD

The present device relates to self-defense, and more particularly, to a wall-mounted removable bullet proof shield or shielding and alarm designed to protect potential victims who may be caught off guard and would otherwise be unprotected.

BACKGROUND

Historically, mankind has endured violence in the forms of warfare, personal threats, crime, and all manner of conflicts. Naturally, protection from threats early in history include the use of shields. As with every invention, the shield started as a crude instrument that was designed and constructed for a specific purpose in warfare. As time evolved, the shields used in medieval times became more of a work of art as the soldiers and warriors took the use of shields as an integral part of their arsenal. Assorted sizes, shapes, and materials were used by the Greek and Roman Soldiers for specific purposes. Shields were commonly made of wood and animal hides. They tended to be round, small and used for close range defense. Metal had not begun to be used during the days of wooden armor and shields. During the early medieval times, around the 10th century, the Kite shield was developed as a full body length shields that tapered from the top toward the bottom. One attachment that was developed for the Kite shield was a set of leather straps that enable the soldier or knight to attach the shield to his forearm.

Shields were effective in defense against knives, swords, arrows, and spears in battle. However, obviously they were not effective for personal uses against ballistic weaponry. Modern weapons continue to advance with ballistic fire-power and rapidity of rounds delivered. The shield has little or no application in modern warfighting technique or training. To protect warfighters from the automatic and semi-automatic rifles and pistols, soldiers, marines, and warfighters are sheltered in light armored vehicles and are equipped with armored breastplates in the bulletproof vests. They must wear these always on the battlefield and this can be physically demanding and physiologically draining after hours of use on the battlefield. The warriors must get rest and relief from the rigors of carrying that armor.

Today, typically only those in law enforcement and an elite group of elites use bullet proof vests. Certain shields have been developed for use as riot shields, or large shields to protect one or more individuals during an anticipated law enforcement action. These modern shields have been designed for protection when violent gunfire is anticipated, and law enforcement intends to move into harm's way with the protection of the shields.

Active shootings in vulnerable locations or facilities, such as schools, have been widely reported since the early 1990s, such as that in Columbine High School in Colorado. Such violence has continued to plague America with mass shooting tragedies killing scores of unsuspecting, unprotected, unarmed persons, largely children. On Feb. 14, 2018, there were 17 murdered and 14 more wounded in a shooting at Marjory Stoneman Douglas High School, Parkland Fla. There are nearly 50.7 million public school students in America today. Since the shootings at Columbine, some have estimated that there have be about 214,000 students exposed to mass shootings in schools.

It would be desirable if self-defense devices could be provided in vulnerable facilities, such as schools, to protect potential victims, such as students, from active shooters.

SUMMARY

Embodiments of the present approach or system may include pre-staged bulletproof shields that will be available to typically unarmed persons for use upon recognition or notification or alert of an active shooter on the premises. One reason such shooters may be able to kill so many is that there have been no such protections installed in places where masses of people or congregations gather, such as schools, churches, concerts, theaters, and other like venues. A facility equipped with wall mounted shields, for example, may cause a would-be shooter to re-think the location as the potential targets would have access to protection. A unique or distinctive alarm may be provided, such as a drumbeat alert, which will enable the potential victims to instantly recognize the active shooter alert without delay caused by confusion with a fire alarm. It will give unarmed persons the opportunity to shield themselves if caught near an active shooter. Such persons may also be able to exit the vicinity while using the protection from a shield. Further, a unique or distinctive alarm may be used to alert law enforcement to the active shooter's location.

As noted above, current non-military use of bullet proof shields is primarily for law enforcement in anticipation of an engagement. Law enforcement may pick up equipment offsite from a storage location and carry a shield to the site of anticipated gunfire. Although this may be accomplished in a matter of minutes and the officers may arrive in less than 10 minutes to a crime scene, most active shooter attacks are completed in 2 to 5 minutes. The Feb. 14, 2018 shooting at Marjory Stoneman Douglas High School in Florida killed 17 students and staff members and wounded 14 others in only 6 minutes and 20 seconds. This makes the deployment of police with bullet proof shields to the scene likely to be ineffective for saving lives of persons located in a vulnerable site; a shooting may be complete before first responders can arrive.

Further, schools and churches have historically not been considered as needing bullet proof devices. While the probability of encountering an active shooter is very small, the danger is potentially fatal for multiple victims. An analogy may be drawn to the risk of a fire emergency at a school, church, or university. While the risk of fire may be relatively low, those facilities are still provided with reasonable protection given the potential harm; fire codes, fire alarms, and fire extinguishers are ubiquitous, protecting those located within such facilities. In a like manner, these facilities may be equipped with systems that offer bullet proof protection such as bullet proof shields pre-staged in a desired location (e.g., wall mounted) that are available when needed. Vulnerable persons may be trained in their use and procedures for response.

Conventional bullet proof shields may be too heavy for persons to carry around for extended periods during daily activities. It is impractical to expect attendees of school, work, or church to bring a bullet proof back pack or a bullet proof vest, for example. A pre-staged shield may address this risk, and may be designed in a size (e.g., 20"×30") to protect an average, unarmed person's head and torso.

It is an object to provide a personal shielding and alarm system for protecting an individual against gunshots fired by a shooter and alerting others to the presence of the shooter.

It is an object of the present system and devices to make bullet proof protection or shielding available to individuals in vulnerable facilities.

It is an object to provide a new and improved communication protocol for the interconnected shooter alert monitors and alarms. A further object of this invention to provide a new and improved communication protocol that may be compatible with the standard 3 wire interconnect systems currently employed. It is an additional object of this invention to provide a communication protocol in such a manner to meet industry standards, such as Underwriters' Laboratories standards for proper temporal pattern alarming during each of the active shooter conditions.

It is an additional object to provide a new and improved alert condition detector that employs a communications protocol capable of distinguishing itself from the fire and smoke alarm condition.

In one embodiment, the personal shielding and alarm system comprises a shield having a vertically elongated shape with a front face and a rear face adapted with a predetermined size to cover and protect a torso of an individual when positioned behind the front face of the shield and a primary alarm system for alerting others to the presence of a shooter. The shield is comprised of a bullet-resistant material adapted to prevent high velocity projectiles from penetrating through the front face of the shield. One or more handles are accessible from the rear face of the shield adapted for an individual to grip the shield by the one or more handles in front of the torso of the individual and to carry the shield while the individual is ambulating. The system includes a mounting assembly for mounting the shield onto a surface whereby the handles of the shield are accessible for the shield to be quickly removed from the mounting assembly. In one embodiment, the mounting assembly comprises a seat for holding a bottom edge of the shield. A switch is installed on the mounting assembly to indicate whether the shield is mounted onto the mounting assembly. The primary alarm system comprises a circuit having a power supply, a signal generator in operable communication with the switch and adapted to generate a signal when the switch indicates that the shield is not mounted on the mounting assembly, and at least one annunciator adapted to receive the signal from the signal generator and to communicate a shooter alert for alerting others to the presence of the shooter.

The primary alarm system may be interconnected with one or more secondary alarm systems whereby the signal generator sends a secondary signal to the one or more secondary alarm systems when the switch indicates that the shield is removed from the mounting assembly. For example, a wire connection system may be connected to the primary alarm system and the secondary alarm systems. The wire connection system comprises a neutral wire, a hot wire to provide power to the primary and secondary alarm systems, and a signal wire for interconnecting the primary alarm system with the secondary alarm systems, wherein the signal generator is connected to the signal wire and transmits the secondary signals to the secondary alarm systems through the signal wire. The secondary alarm system may be selected from the group comprising a security monitoring system, a public announcement system, a fire alarm system or combinations thereof.

The circuit may comprise a processor and an integrated circuit chip having a non-volatile memory, and wherein the annunciator comprises a loud speaker in electronic communication with the integrated circuit chip, the non-volatile memory storing a reference alert for the processor and generates an audio alert emitted through the loud speaker when the annunciator receives the signal from the signal generator to communicate the shooter alert. The reference alert may have an irregular waveform and a frequency that is not within a frequency range of an audio alarm of the secondary alarm system. In one embodiment, the frequency of the reference alert ranges between about 200 Hz and about 5000 Hz.

The switch may be a mechanical switch, an electrical switch or a magnetic switch. In one example, the switch is a reed switch comprising a first magnetic reed installed on the shield and a second magnetic reed installed on the mounting assembly, whereby the switch indicates that the shield is mounted onto the mounting assembly when the first and second magnetic reeds are in contact with one another.

The bullet-resistant material may be comprised of transparent polymers, acrylic, polyparaphenylene terephthalamide, ceramics, metal, ultra-high molecular weight polyethylene, polycarbonates, carbon fiber or combinations thereof. For example, the shield may be comprised of steel.

One example of a predetermined size of the shield is a width of about 20 inches, a length of about 25 inches, and weighs up to about 15 pounds.

In one embodiment, two handles are affixed to the rear face of the shield. Each of the handles has a length greater than its width and adapted to being encircled by an individual's hand in a power grip whereby the fingers wrap around the handle in one direction and the thumb may wrap around the handle in the other direction. The length of each handle is parallel to the rear face of the shield.

The mounting assembly may have a fastener for mounting the shield onto the surface. For example, a hook and loop fastener may be used to mount the shield onto a surface. The surface may be a wall.

Other objectives and advantages of the primed invention will become more apparent from the following detailed description when taken in conjunction with the accompanying drawings.

BRIEF DESCRIPTION OF THE DRAWINGS

The accompanying drawings incorporated in and forming a part of the specifics illustrate many aspects of the primed invention, and together with the description explain the principles of the primed invention. In the drawings.

DETAILED DESCRIPTION

Figure 1:
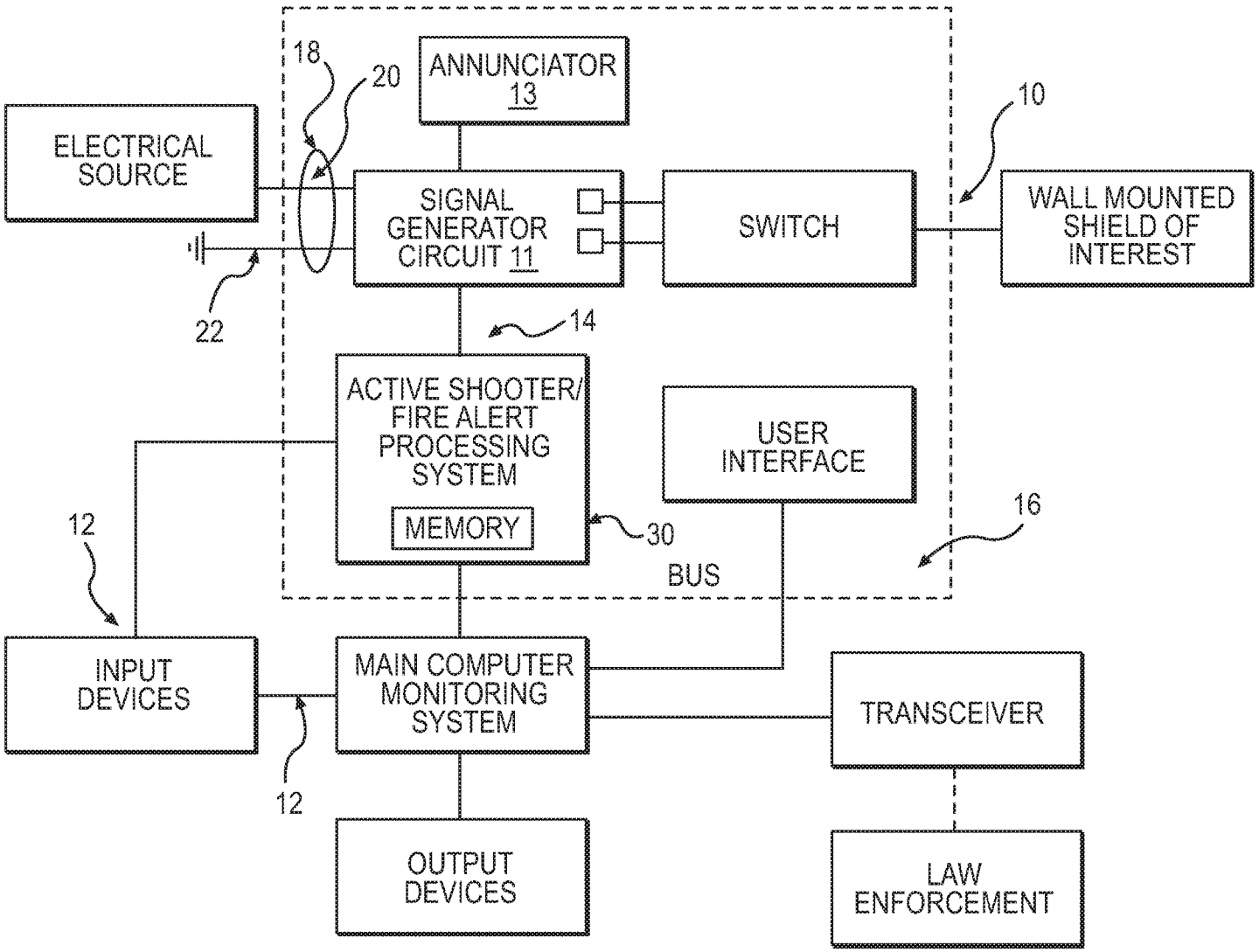
FIG. 1 is a system level block diagram illustrating a distributed, interconnected shooter alert condition monitor and alarm system depicted in accordance with the ideas conceived for the primed invention.

The present approach includes embodiments of a bullet proof shield that may be staged in vulnerable facilities where potential victims may gather. For example, a wall mounted shield may reduce the vulnerability of unarmed persons on the premises of a school or church. A pre-positioned bullet proof shield may be located consistently in a pre-determined, identifiable location that the potential victims may reach quickly.

An embodiment of a shield may be mounted on a wall or other stand with an operable or electronic connection to a switch, such as a weight sensing switch, that may signal a monitoring system when the weight of a shield is lifted. Other types of switches, whether magnetic, resistance, etc., may also be used; for example, a reed switch. Such a switch is in operable communication with a primary alarm system adapted to communicate a shooter alert for alerting others to the presence of the shooter. In one embodiment, the shooter alert is an audible signal that will be distinct or unique—i.e., with distinct many a noise or signal that is separately identifiable from a fire or other conventional alarm.

The audio alert is preferably designed to minimize the time needed for potential victims to react to the audio signal by having a high signal intensity and a frequency range that an ear is sensitive to, yet at the same time, is easily distinguishable from other conventional alarms. In one embodiment, the audio alert may be an audio signal having a frequency in between about 200 Hz and about 5000 Hz. In another embodiment, the audio alert may be a signal within a frequency range between about 500 Hz and about 3000 Hz. Certain embodiments may employ a frequency range below 1000 Hz, particularly for applications wherein the audio alert needs to travel longer distances. Standard fire alarm systems emit an alarm sound at a high frequency of 3100 Hz. Newer fire alarm systems utilize a low frequency alarm sound of 520 Hz. Thus, the frequency selected for the primary alarm system's audio alert is not equal to either the 3100 Hz or 520 Hz frequencies, and preferably, differs from either frequency by at least 100 Hz. The audio alert may be emitted at a signal intensity of between about 65 dB and about 120 dB. In certain embodiments, the audio alert may be emitted at a signal intensity of between about 80 dB and about 100 dB.

Standard fire alarms employ a temporal-three alarm signal, often referred to as "T-3" (ISO 8201 and ANSI/ASA S3.41 Temporal Pattern) and produces an interrupted four count (three half second pulses, followed by a one and one half second pause, repeated for a minimum of 180 seconds). Standard fire alarms emitting at 3100 Hz frequency use a sine waveform, while the 520 Hz frequency emitted from newer fire alarm systems uses a square waveform. In contrast, the audio alert of the primary alarm system may have an irregular waveform with a frequency that is not within a frequency range of an audio alarm of the secondary alarm system. One example of an audio alert may be a drum beat generated from an integrated circuit alarm device that communicates a threat of gunfire (e.g., "Da-Da-Da-Dow"). The drum beat may be in the form of a Morse code; for example, a drum beat having a Morse code pattern signaling "S.O.S." Other examples of an audible signal include a loud shrill sound or an announcement that a shooter has been observed on the premises. This signal may be relayed to other Active Shooter Alert monitors. An Active Shooter Alert will allow persons located in the facility to immediately understand the situation and to take appropriate action.

The optional alarm or alert circuitry may take a variety of forms. In one embodiment, it may be adapted from or incorporated into alarm circuits, using components such as an integrated circuit, NPN transistor, resistor, DC power source, and a pressure sensing switch instead of a heat or smoke sensing switch. The communications protocol for embodiments of the circuit may include interconnected alert and alarm condition sensors, processors, and monitors and signaling methods compatible with industry standards.

Turning now to the drawings, in FIG. 1 is illustrated an exemplary embodiment of a distributed active shooter condition monitor and alarm system constructed in accordance with the present approach. The system includes a primary alarm system 16 adapted to alert others of the presence of a shooter. The primary alarm system 16 includes a switch 10 and a signal generator 11. The switch 10 is connected to a signal generator 11 and indicates whether a shield is mounted onto a mounting assembly. When the switch 10 detects that the shield has been removed, the signal generator 11 generates a signal to the annunciator 13 to produce an audio alert indicating that a shooter is on site. The primary alarm system 16 may be incorporated into a secondary alarm system, or be a modification of a conventional installed smoke or fire alarm detector 12 that do not process and pass through the shooter alert communications protocol of the primed invention. Smoke and fire alarm systems that are adapted to process and pass through the alert communications protocol of the present approach may be capable of sounding a drumbeat or other audio alert 14 as distinct from a fire alarm 12, while preserving the capability of sounding one alarm or the other or both alarm temporal patterns based upon the alert or alarm condition monitored and detected.

The primary alarm system 16 may also be interconnected with one or more secondary alarm systems. This interconnected system 16 may use a 3 wire or other conductor interconnect 18. As indicated briefly above this 3 wire connection provides main AC power via line 20 a neutral wire 22 and a single signal wire 14 that may be used to communicate an alarm condition to all units interconnected in the system 16. The signal generator 11 may be adapted to generate a secondary signal through the single signal wire to interconnected secondary alarm systems. These secondary alarm systems may include smoke or fire alarms, public announcement systems, and law enforcement. While this embodiment of system 16 is illustrated as having a particular configuration of distributed sensors 10, one skilled in the art will recognize that such a system 16 illustrated in FIG. 1 has been constructed to illustrate various aspects, and therefore is presented by way of illustration and not limitation.

Recognizing that several types and configurations of distributed sensing and detector systems may exist using the standard 3 wire interconnect 18, it is preferable that the protocol of the present approach may be backward compatible with prior interconnect systems to permit retrofitting. Specifically, the protocol may be capable of providing an indication of existing smoke and fire sensors that they will recognize and process as a fire alarm when smoke or fire is indicated. Likewise, the protocol may also be capable of providing an audio alert when a shield is unseated for protection of unarmed persons from an active shooter.

Figure 2:
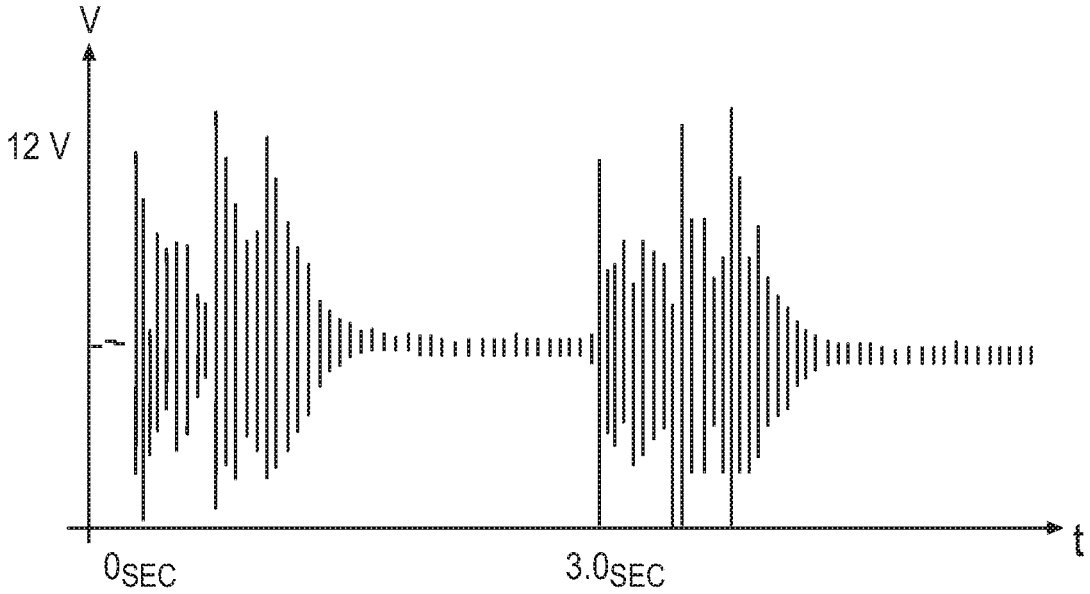
FIG. 2 is a graphical illustration of the drumbeat waveform audio signals generated on the single I/O wire interconnect for the active shooter alert and alarm in accordance with an embodiment of the communications protocol of the primed invention.

The embodiment of an audio wave form shown in FIG. 2 will be processed through the interconnected communications protocol at a distinct level that will not inadvertently trigger the fire alarm, although it may be transmitted on the same single I/O wire; it may be understood by the processor as a different alert, or it will be ignored by the processor for sounding the fire alarm temporal pattern. To ensure that interconnected active shooter alarms deployed throughout the system will sound an alert at the appropriate time, the processor may recognize the switch signal and pass an audio alert when the switch senses a shield has been lifted from its seat. Conversely, in the event there is a combination of alarms and alerts sensed at the same time (e.g., for fire and active shooter), then the temporal patterns for both alarm signals may be passed and the appropriate combination of alarms and alerts will be processed and sounded.

Figure 3:
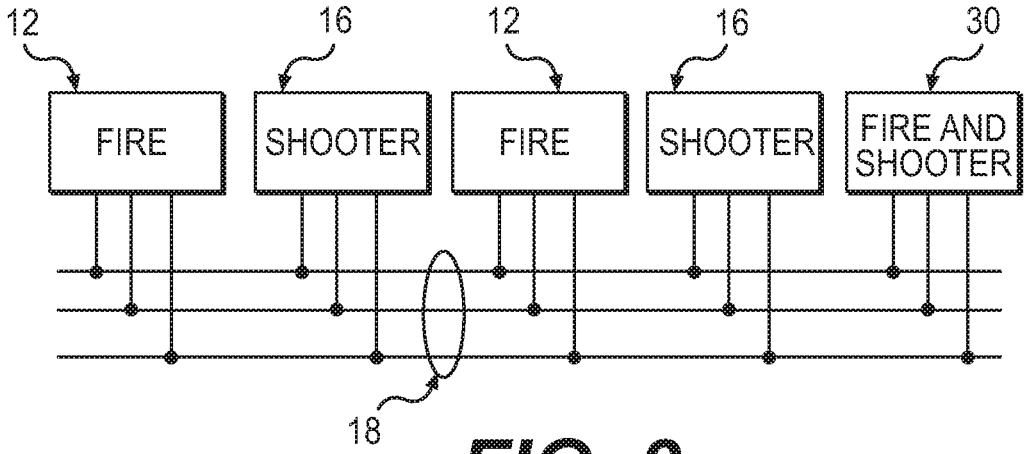
FIG. 3 is a block diagram of an exemplary active shooter monitor and alarm system constructed in accordance with the ideas conceived for the primed invention.

FIG. 3 is a block diagram depicting an embodiment of the interconnect protocol with fire alarms 12 and active shooter alert alarms 10. Since the conventional fire detectors 12 are not adapted or programmed to process an active shooter alert, such portions will typically remain silent in the absence of a sensing signal. Conversely, when the combination unit 30 senses both a fire emergency and an active shooter, it will process and transmit both distinct temporal pattern and sound both active shooter alerts and fire alarm signals. Since the signaling protocol of the present approach may have backward compatibility for interconnected systems, it is inexpensive and the lines employed may not create a large amount of electrical noise. The embodiment of signal illustrated in FIG. 2 may be seen as random noise to a fire alarm, however the DC voltage level of the drumbeat signal is shown as having four distinct beats every three seconds with enough amplitude to be distinguished above the 60 Hz noise level on the lines.

Figure 4:
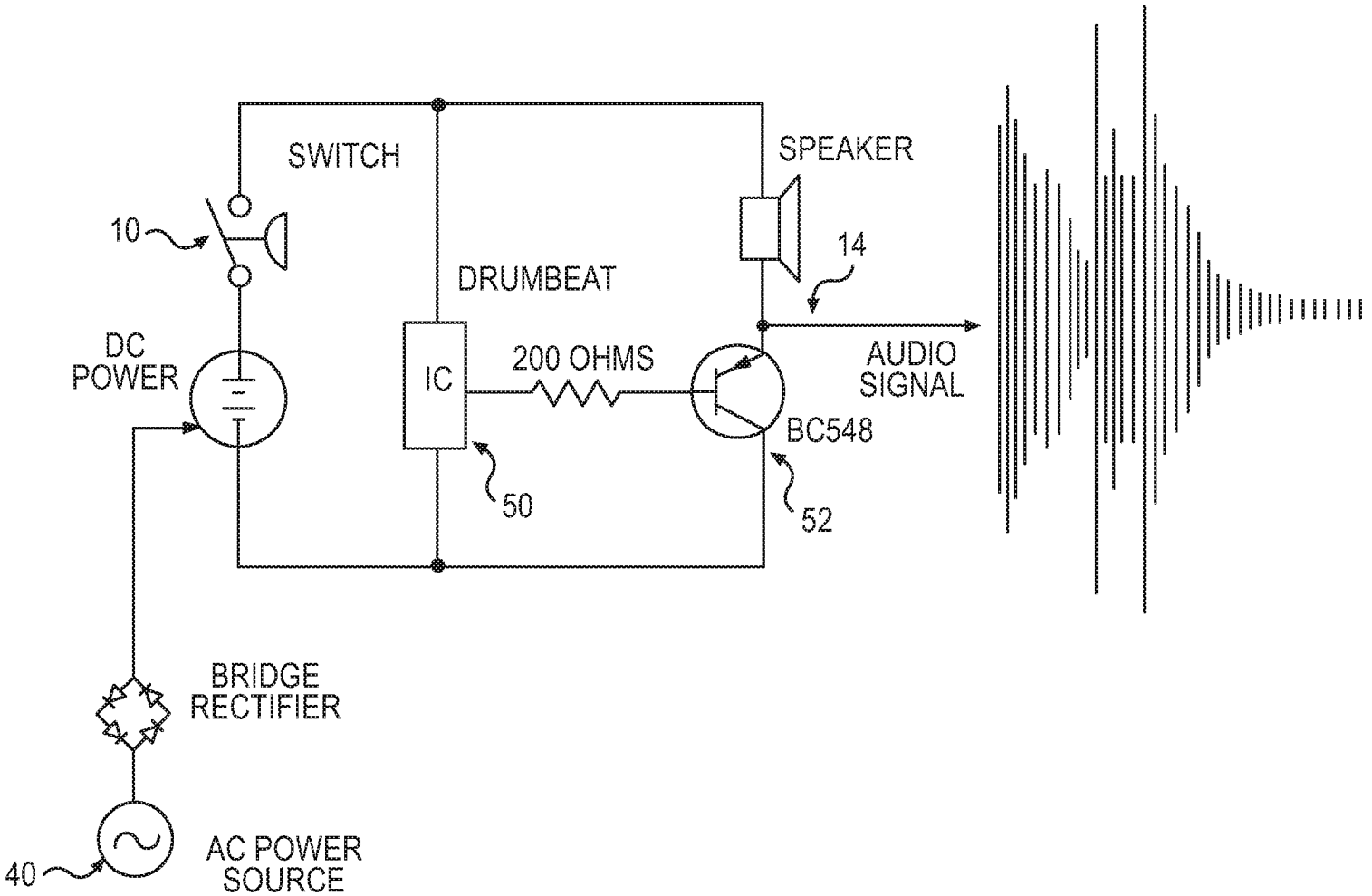
FIG. 4 is a simplified circuit schematic diagram of and embodiment of the weight pressure switch within the shield seat in accordance with the ideas conceived for the primed invention.

FIG. 4 illustrates an exemplary, distinct signal using a drumbeat generated in accordance with the conceptual idea of the communications protocol. This drumbeat alone conveys a different distinct signal and will avoid any confusion from the listener, allowing more time for correct and decisive action to reach a shield or seek cover. The persons in an installed facility will be better protected with access to covering shields proximal.

To halt an alert signal, a removal or disconnect of AC power source 40 may permit a reset of the shooter alert signal and allow for the shields to be replaced on the switch 10, opening the DC power line. Integrated circuit chip 50 may be a Programmable Read-Only Memory (PROM) chip designed to generate a drumbeat alert signal that can be developed across a 200 ohm resistor through NPN transistor 52 and applied as an audio drumbeat signal at junction 14 to speakers and interconnect the signals to monitors.

Figure 5A:
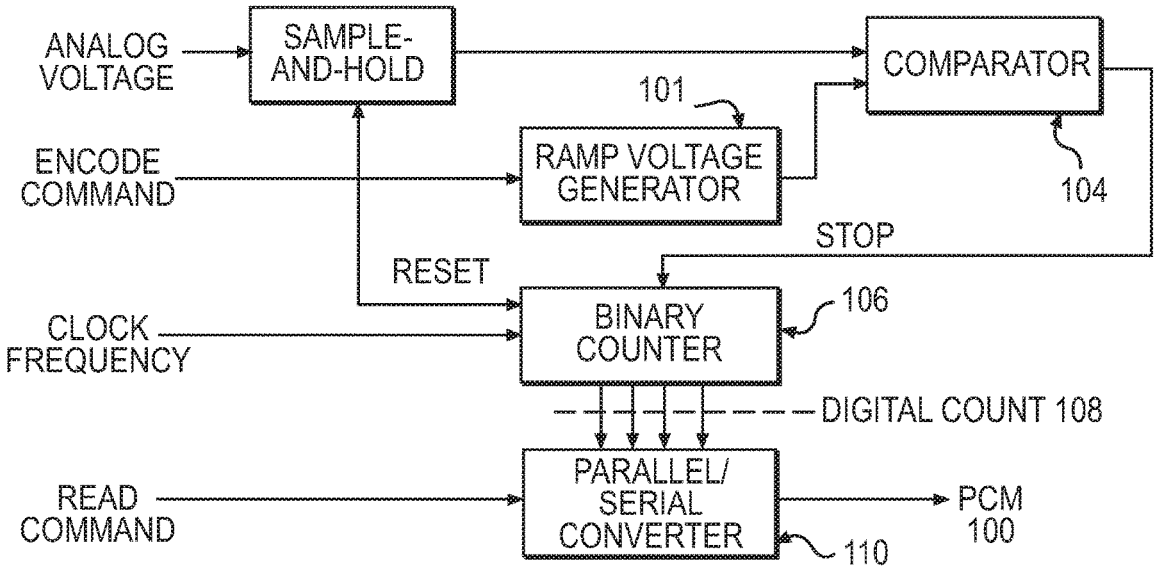
FIG. 5A is a schematic diagram of generating a PCM signal using a ramp encoder.
Figure 5B:
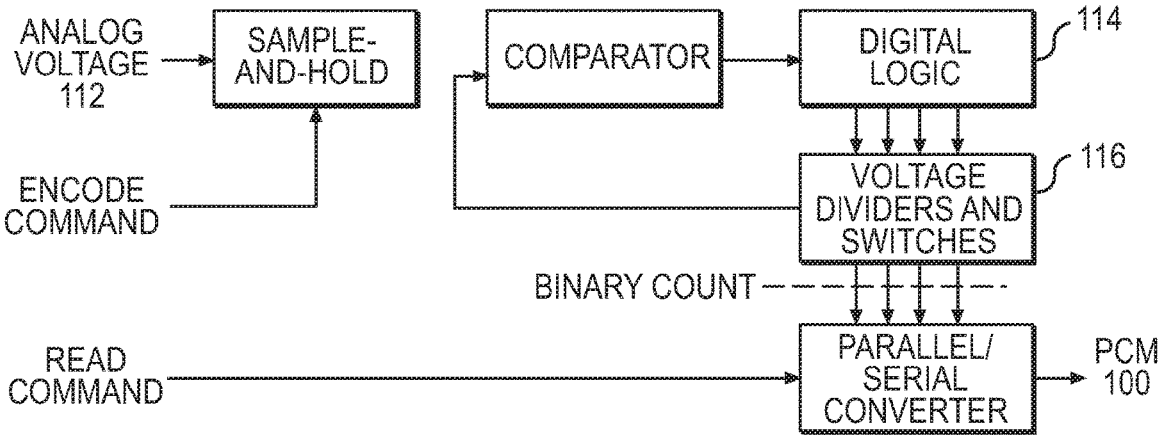
FIG. 5B is a schematic diagram of generating a PCM signal using a feedback encoder.

The audio alert may be sent to the speaker as a PCM signal 100. FIG. 5A provides one example of generating a PCM signal 100 using a ramp encoder 101. The ramp encoder 101 generates a linear ramp from an input signal. The data is fed to a comparator 104, and the comparator 104 is connected to a binary counter 106 and provides a digital count 108 to the parallel/serial converter 110. FIG. 5B provides another example of generating a PCM signal 100 using a feedback encoder. The feedback encoder operates by successively comparing the analog voltage input 112 with a series of trial voltages. Successive trials are governed by the outcomes of previous decisions as to whether the trial voltage is greater or less than the level of the analog input. The trial voltages are generated from a series of voltage dividers 114 with switches controlled by a digital-logic configuration 116. The code corresponding to the input voltage level can be read from the position of the switches in the voltage-divider network. The use of a PCM signal enables efficient storage of the audio alert and easy signal modulation.

Figure 6:
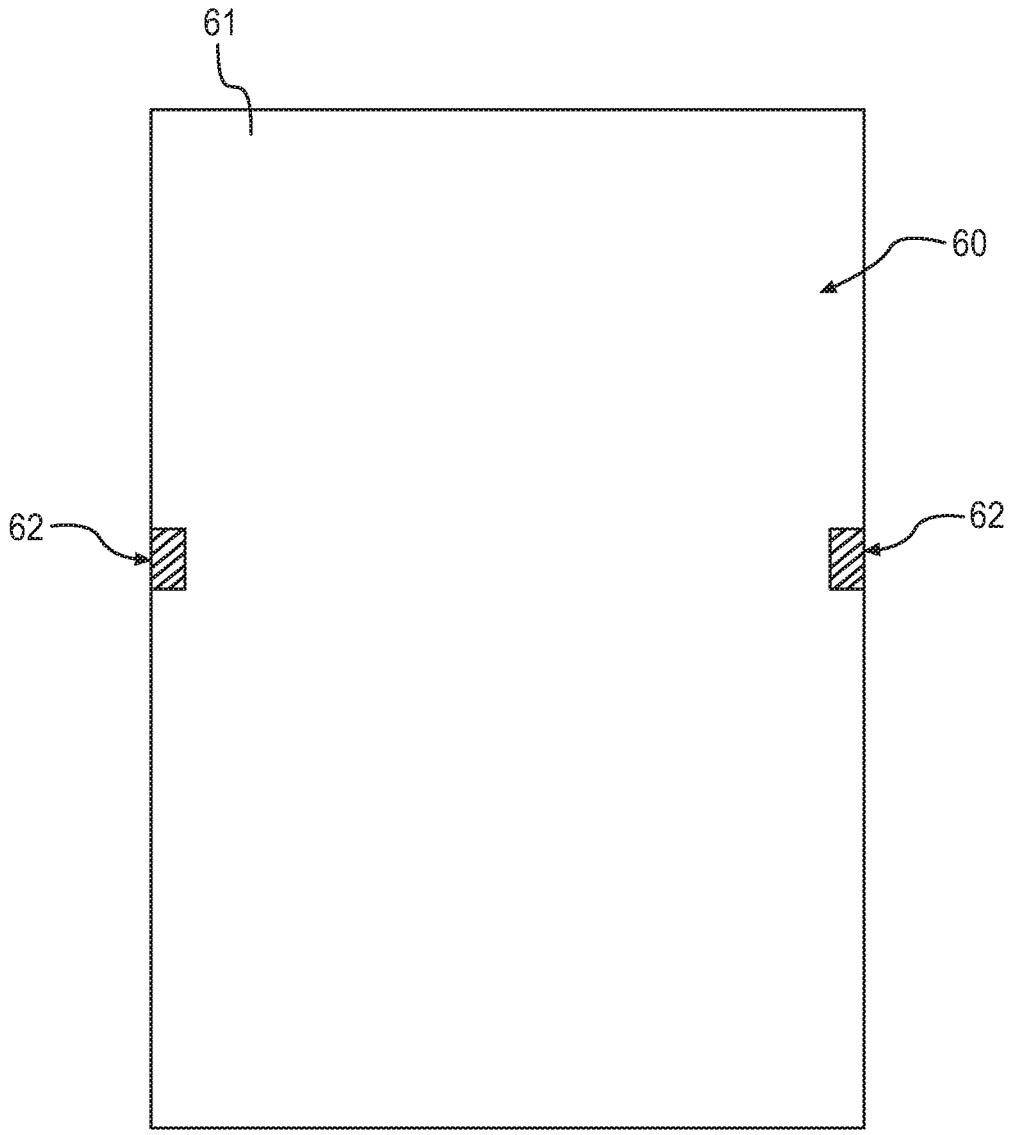
FIG. 6 is a front view of the wall mountable shield primed invention with fasteners for the cloth strap.

FIG. 6 is a front view of an embodiment of shield 60 having a front face 61 with fasteners 62 on the left and right side for a cloth or leather strap for holding the shield when it is removed from its seat. Other holding devices, such as handles, hand grips, etc., may be used as well. The size, shape, weight and overall design of the shield is preferably optimized so that it is quickly accessible and ready-to-use, covers and protects all vital organs, allows sufficient mobility and visibility to enable ambulation while the shield is in use, and is lightweight for both prolonged use without fatigue and to enable smaller-sized adults and children to carry the shield. The shield may have a vertically elongated shape, such as a rectangular shape, of a predetermined size so as not to interfere with walking and running, while also permitting a user to shelter in place with maximal coverage from the shield. For this embodiment, shields may have nominal dimensions of 20"×30" by ¾" and weigh approximately 10 pounds each.

Cost of bullet proof materials can be high, and such facilities may lack funding for implementation. Of course, the saving of a single life may justify use of the present approach. However, it is considered that the present approach may be modified or tailored to reduce the cost of implementation.

The personal shield and alarm system described herein may also be adapted for home and private use. Such use may also involve interconnection with an alarm and alert system and would be optional depending upon the user's requirements. Public or private use may involve an interconnected alarm and alert system triggered by a switch.

Shields of the present approach may be manufactured from any one material selected from of an assortment of materials—such as transparent polymers, acrylic, poly-paraphenylene terephthalamide (available under the Kevlar® brand name from DuPont), ceramics, or solid metals. The difference in the material may be selected by the user for their more specific purposes. A transparent or partially transparent polymer may be used if it is desired that a user may keep visual track of the shooter, depending on the sizing of the shield. A metal shield, for example, may be used if the intent is that a user simply exit the area of the shooter to the nearest safe spot. Either choice is better than remaining unprotected.

Other sample bullet-resistant materials (also called ballistic materials or, equivalently, anti-ballistic materials) such as Ultra High Molecular Weight Polyethylene (UHMWPE), polycarbonates, or carbon fiber composite materials, or a material may be basic and simple, such as steel or titanium.

The shield may include one or more handles accessible from the rear face of the shield to enable an individual to hold the shield in front and carry it while maneuvering. Each handle may be affixed to the rear face and have a length greater than its width and adapted to being encircled by an individual's hand in a power grip whereby the fingers wrap around the handle in one direction and the thumb may wrap around the handle in the other direction, the length of each handle parallel to the rear face of the shield. In some embodiments, the handles are ambidextrous to allow a user to grasp with either hand. The handles may be designed to have large contact services to distribute the force over a larger area and to direct it to less-sensitive areas, such as the tough tissue between the thumb and index finger. The handle may omit finger grooves or other recess to enable a large variety of hand sizes to grasp the handle.

Figure 7:
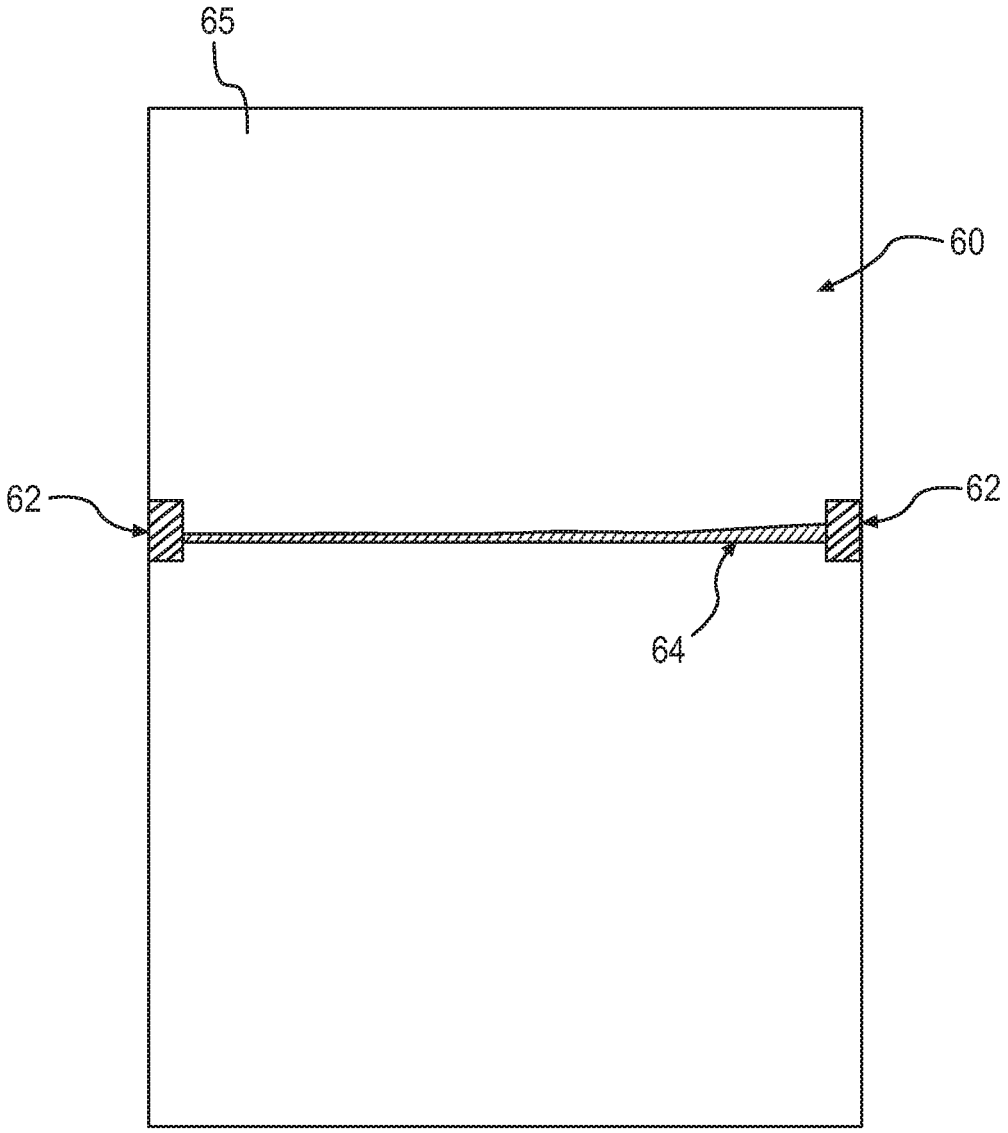
FIG. 7 is a rear view of the wall mountable shield primed invention with cloth strap and fasteners.

Turning to FIG. 7, a rear view of an embodiment of a shield 60 showing a strap 64 accessible from the rear face 65 that can be used for holding the shield firmly against the wall until it is removed from the seat. Once it is lifted from its seat the strap is used for holding the shield for protection and carrying the shield to a safe location away from the shooter.

Figure 8:
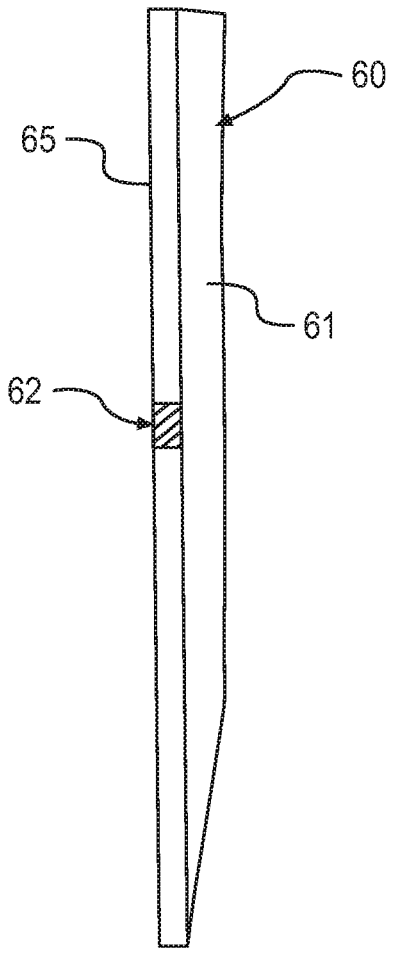
FIG. 8 is a side view of the wall mountable shield primed invention with fasteners.

Turning to FIG. 8 is a side view of an embodiment of a shield 60 showing one fastener 62 for the holding strap to be securely fastened.

Figure 9:
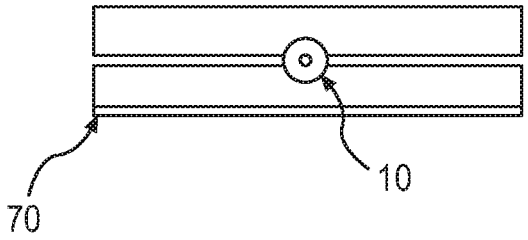
FIG. 9 is a top view of the shield seat with the weight pressure sensing switch.

Turning to FIG. 9 is a top view of a shield seat 70, with the weight pressure sensing switch 10 or alternative embedded in the seat.

Figure 10:
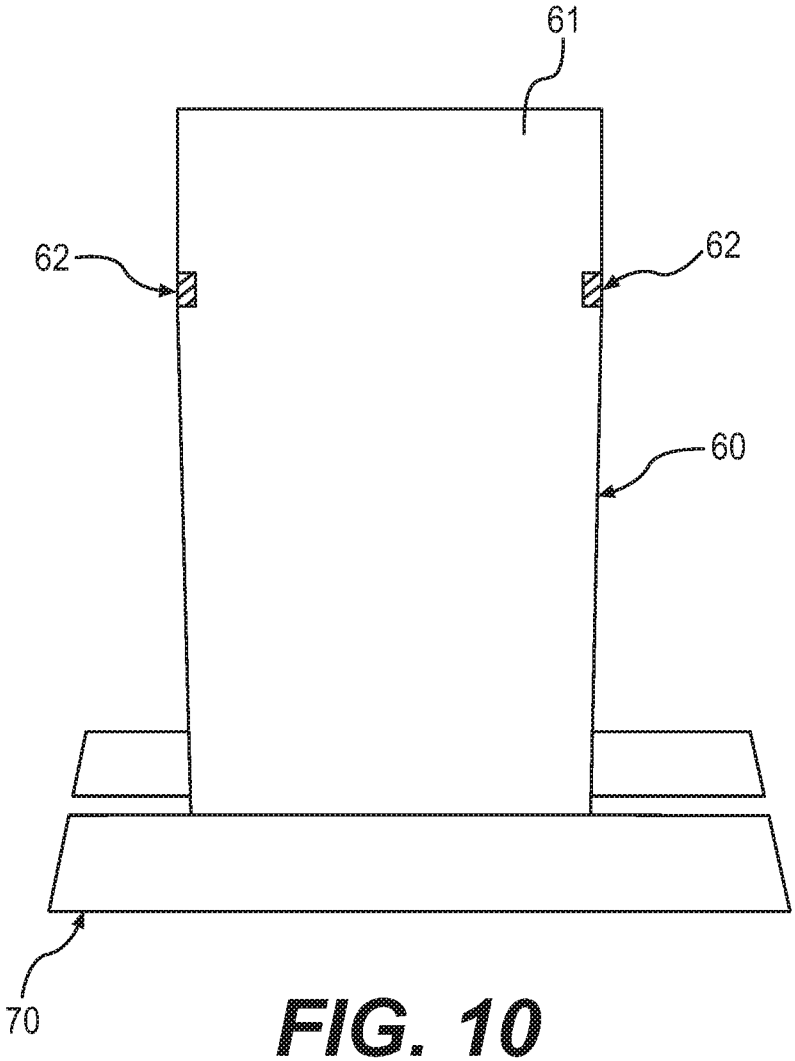
FIG. 10 is the front view of the wall mounted shield and shield seat.

Turning to FIG. 10 a front view of an embodiment of a wall mounted shield 60 placed upon its seat 70 in a primed position.

Figure 11:
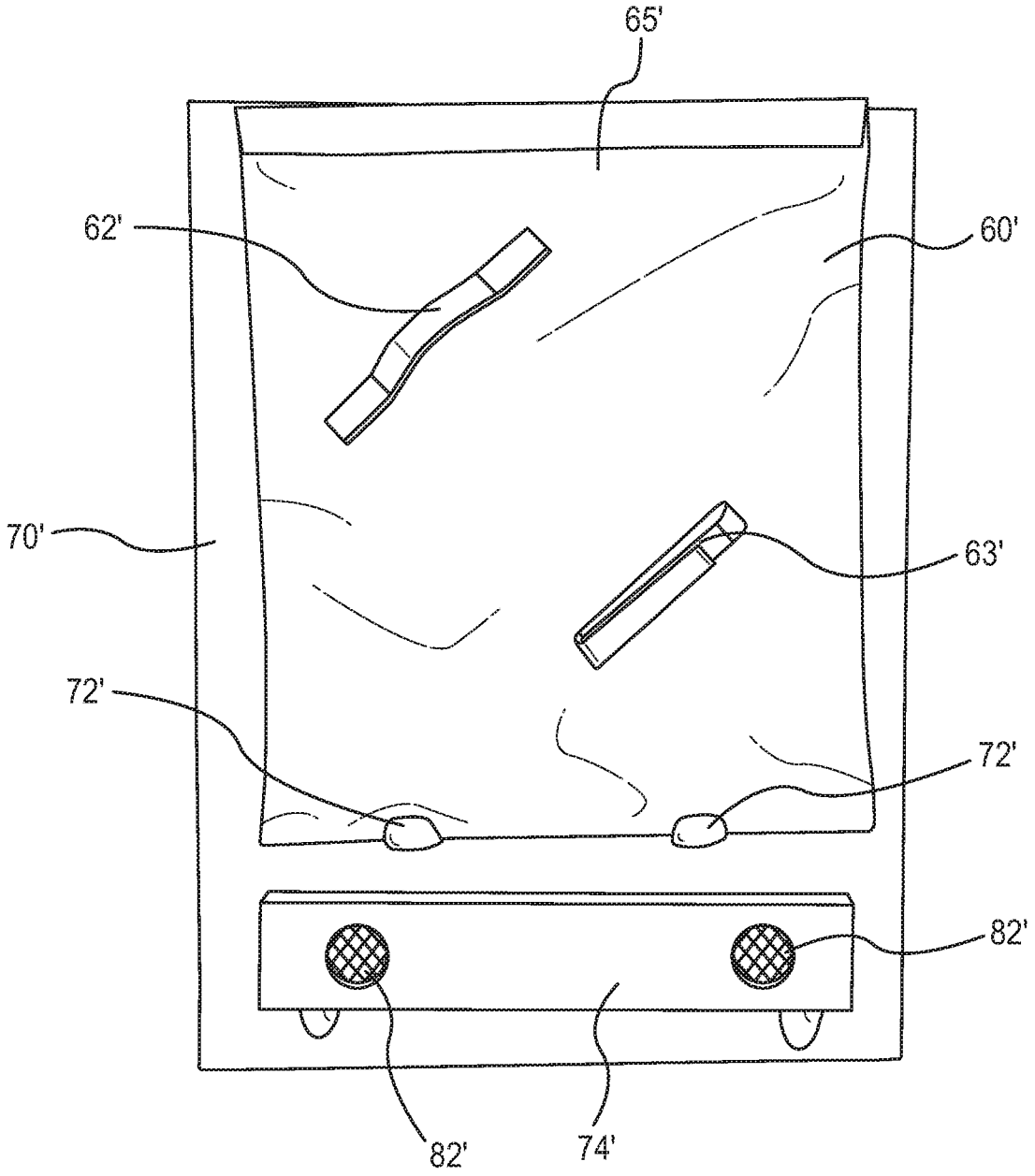
FIG. 11 is a front view of a shield and mounting assembly in accordance with another embodiment of the primed invention.

FIG. 11 is a front view of a shield 60' mounted onto a mounting assembly 70' according to another embodiment. The shield 60' includes a first handle 62' and a second handle 63' for a user to hold while carrying the shield 60'. The shield 60' is comprised of an ultra-high molecular weight polyethylene adapted for a small child to carry, having a length of 24 inches, a width of 20 inches and a weight of about 15 pounds. In this embodiment, the handles 62' and 63' are comprised of nylon and are located on a rear face and are readily accessible. The handles 62' and 63' are designed to be ambidextrous and held using a power grip.

Figure 12:
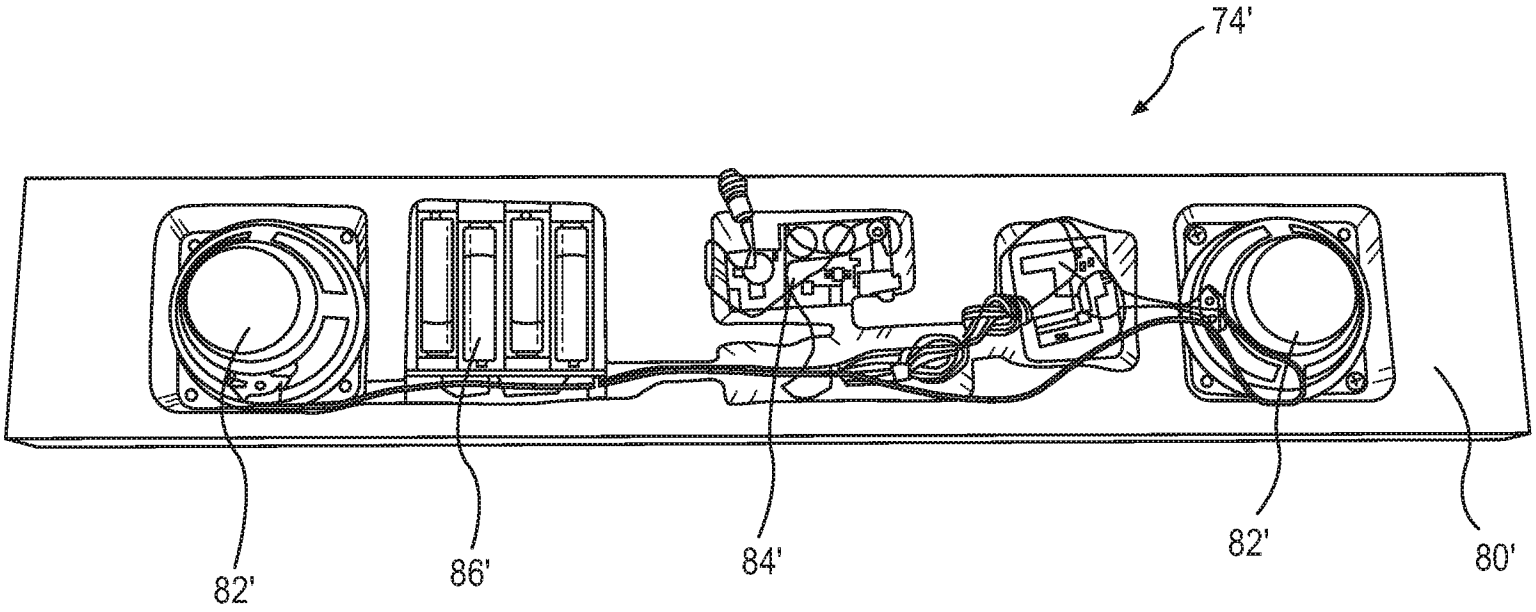
FIG. 12 is a rear view of a speaker assembly in accordance with one embodiment of the primed invention.

As seen in FIG. 11, the mounting assembly 70' includes a pair of supports 72' forming a seat to hold the shield 60'. In another embodiment, the seat may be substituted with a fastener to mount the shield 60' onto a surface. For example, the shield 60' may be mounted using a hook and loop fastener. A speaker assembly 74' is included for signaling an audio alert when the shield 60' is removed from the mounting assembly 70'. FIG. 12 is a rear view of the speaker 74' shown in FIG. 11. The speaker assembly 74' comprises a housing 80' having a pair of speakers 82' connected to an integrated circuit chip 84' and powered by a set of batteries 86'.

Figure 13:
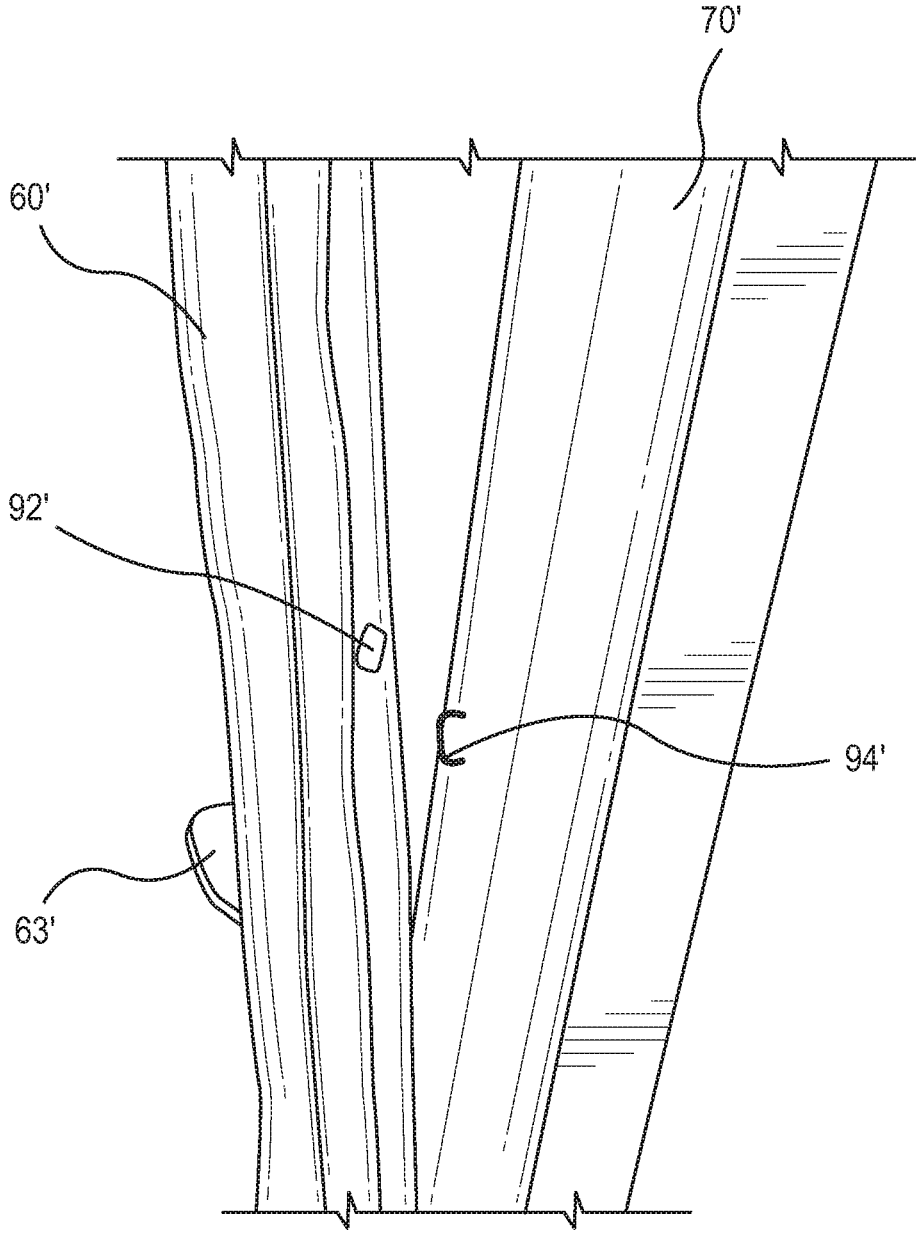
FIG. 13 is an enlarged side view of a shield and mounting assembly having a switch in accordance with one embodiment of the primed invention.
Figure 14:
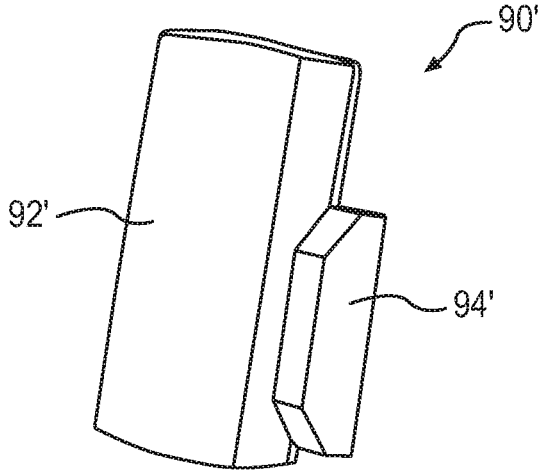
FIG. 14 is a perspective view of a reed switch.
Figure 15:
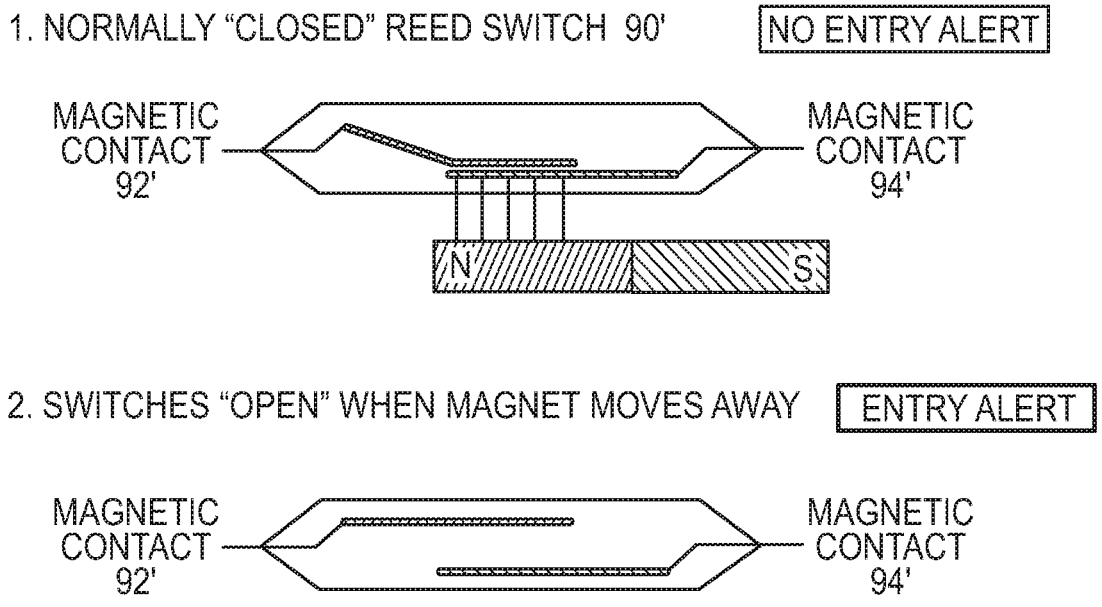
FIG. 15 is a schematic illustrating the reed switch in operation.

FIG. 13 is an enlarged side view showing one embodiment of a switch 90' for detecting whether shield 60' is mounted or removed from the mounting assembly 70'. In this embodiment, the switch 90' is a reed switch comprising a first magnetic reed 92' installed onto the shield 60' and a second magnetic reed 94' installed onto the mounting assembly 70'. A close-up view of the first magnetic reed 92' and the second magnetic reed 94' is shown in FIG. 14. FIG. 15 provides an illustration for how the reed switch works in operation. The reed switch is an electrical switch operated by an applied magnetic field. When the first magnetic reed 92' and second magnetic reed 94' are in contact, the circuit is closed. When the shield 60' is removed from the mounting assembly 70', the first magnetic reed 92' is no longer in contact with the second magnetic reed 94' and the circuit opens, causing the alarm system to generate an alert.

While the invention will be described in connection with certain preferred embodiments, there is no intent to limit it to those embodiments. On the contrary, the intent is to cover all alternatives, modifications and equivalents as included within the spirit and scope of the invention.

The foregoing description of the various preferred embodiments of the primed invention has been presented for the purpose of illustration and description. It is not intended to be exhaustive or to limit the invention to the forms disclosed. Obvious modifications or variations are possible in adaption of the conceptual ideas. The embodiments discussed were chosen and described to provide the best illustration of the principles of the invention and its practical application to thereby enable one of ordinary skill in the art to utilize the invention in various embodiments and with various modifications as are suited to the particular use contemplated. All such modifications are variations within the scope of the invention as determined by the appended claims when interpreted in accordance with the breadth to which they are fairly, legally, and equitably entitled.

It is noted that any one or more aspects or features described with respect to one embodiment may be incorporated in a different embodiment although not specifically described relative thereto. That is, all embodiments and/or features of any embodiment can be combined in any way and/or combination. Applicant reserves the right to change any originally filed claim or file any new claim accordingly, including the right to be able to amend any originally filed claim to depend from and/or incorporate any feature of any other claim although not originally claimed in that manner. These and other objects and/or aspects of the present invention are explained in detail in the specification set forth below.

What is claimed is:

1. A personal shielding and alarm system for protecting an individual against gunshots fired by a shooter and alerting others to the presence of the shooter, the system comprising:

a shield having a vertically elongated shape with a front face and a rear face adapted with a predetermined size to cover and protect a torso of an individual when positioned behind the front face of the shield, the shield comprising a bullet-resistant material adapted to prevent high velocity projectiles from penetrating through the front face of the shield;

one or more handles accessible from the rear face of the shield adapted for an individual to grip the shield by the one or more handles in front of the torso of the individual and to carry the shield while the individual is ambulating;

a mounting assembly for mounting the shield onto a surface whereby the handles of the shield are accessible for the shield to be quickly removed from the mounting assembly, the mounting assembly comprising a seat for holding a bottom edge of the shield;

a switch installed on the mounting assembly adapted to indicate whether the shield is mounted onto the mounting assembly; and a primary alarm system for alerting others to the presence of a shooter, the primary alarm system comprising a circuit having a power supply, a signal generator in operable communication with the switch and adapted to generate a signal when the switch indicates that the shield is not mounted on the mounting assembly, and at least one annunciator adapted to receive the signal from the signal generator and to communicate a shooter alert for alerting others to the presence of the shooter.

2. The personal shielding and alarm system of claim 1, wherein the primary alarm system is interconnected with one or more secondary alarm systems whereby the signal generator sends a secondary signal to the one or more secondary alarm systems when the switch indicates that the shield is removed from the mounting assembly.

3. The personal shielding and alarm system of claim 2, wherein the secondary alarm system is selected from the group comprising a security monitoring system, a public announcement system, a fire alarm system or combinations thereof.

4. The personal shielding and alarm system of claim 2, further including a wire connection system connected to the primary alarm system and the secondary alarm systems, the wire connection system comprising a neutral wire, a hot wire to provide power to the primary and secondary alarm systems, and a signal wire for interconnecting the primary alarm system with the secondary alarm systems, wherein the signal generator is connected to the signal wire and transmits the secondary signals to the secondary alarm systems through the signal wire.

5. The personal shielding and alarm system of claim 2, wherein the circuit comprises a processor and an integrated circuit chip having a non-volatile memory, and wherein the annunciator comprises a loud speaker in electronic communication with the integrated circuit chip, the non-volatile memory storing a reference alert for the processor and generates an audio alert emitted through the loud speaker when the annunciator receives the signal from the signal generator to communicate the shooter alert.

6. The personal shielding and alarm system of claim 5, wherein the reference alert has an irregular waveform and a frequency that is not within a frequency range of an audio alarm of the secondary alarm system.

7. The personal shielding and alarm system of claim 6, wherein the frequency of the reference alert ranges between about 200 Hz and about 5000 Hz.

8. The personal shielding and alarm system of claim 1, wherein the switch is selected from the group comprising a mechanical switch, an electrical switch and a magnetic switch.

9. The personal shielding and alarm system of claim 8, wherein the switch is a reed switch comprising a first magnetic reed installed on the shield and a second magnetic reed installed on the mounting assembly, whereby the switch indicates that the shield is mounted onto the mounting assembly when the first and second magnetic reeds are in contact with one another.

10. The personal shielding and alarm system of claim 1, wherein the bullet-resistant material is selected from the group comprising transparent polymers, acrylic, polyparaphenylene terephthalamide, ceramics, metal, ultra-high molecular weight polyethylene, polycarbonates, carbon fiber or combinations thereof.

11. The personal shielding and alarm system of claim 10, wherein the bullet-resistant material is comprised of steel.

12. The personal shielding and alarm system of claim 10, wherein the predetermined size of the shield has a width of about 20 inches, a length of about 25 inches, and weighs up to about 15 pounds.

13. The personal shielding and alarm system of claim 1, wherein two handles are affixed to the rear face of the shield, each handle having a length greater than its width and adapted to being encircled by an individual's hand in a power grip whereby the fingers wrap around the handle in one direction and the thumb may wrap around the handle in the other direction, the length of each handle parallel to the rear face of the shield.

14. The personal shielding and alarm system of claim 1, wherein the mounting assembly comprises a fastener for mounting the shield onto the surface.

15. The personal shielding and alarm system of claim 14, wherein the fastener is a hook and loop fastener.

16. The personal shielding and alarm system of claim 1, wherein the surface is a wall.

17. A personal shielding and alarm system for protecting an individual against gunshots fired by a shooter and alerting others to the presence of the shooter, the system comprising:

a bulletproof shield having a vertically elongated shape with a front face and a rear face adapted with a predetermined size to cover and protect a torso of an individual when positioned behind the front face of the shield, the shield comprised of ultra-high molecular weight polyethylene and adapted to prevent high velocity projectiles from penetrating through the front face of the shield;

one or more handles affixed to the rear face of the shield adapted for an individual to grip the shield by the one or more handles in front of the torso of the individual and to carry the shield while the individual is ambulating, each handle having a length greater than its width and adapted to being encircled by an individual's hand in a power grip whereby the fingers wrap around the handle in one direction and the thumb may wrap around the handle in the other direction, the length of each handle parallel to the rear face of the shield;

a mounting assembly for mounting the shield onto a surface whereby the handles of the shield are accessible for the shield to be quickly removed from the mounting assembly, the mounting assembly comprising a fastener for mounting the shield onto the surface;

a reed switch comprising a first magnetic reed installed on the bulletproof shield and a second magnetic reed installed on the mounting assembly, whereby the switch indicates that the bulletproof shield is mounted onto the mounting assembly when the first and second magnetic reeds are in contact with one another and indicates that the bulletproof shield is removed from the mounting assembly when the first and second magnetic reeds are not in contact with one another; and a primary alarm system for alerting others to the presence of a shooter, the primary alarm system comprising a circuit having a power supply, a signal generator in operable communication with the switch and adapted to generate a signal when the switch indicates that the shield is not mounted on the mounting assembly, and at least one annunciator adapted to receive the signal from the signal generator and to communicate a shooter alert for alerting others to the presence of the shooter.

18. A personal shielding and alarm system for protecting an individual against gunshots fired by a shooter and alerting others to the presence of the shooter, the system comprising:

a bulletproof shield having a vertically elongated shape with a front face and a rear face adapted with a predetermined size to cover and protect a torso of an individual when positioned behind the front face of the shield, the shield comprised of ultra-high molecular weight polyethylene and adapted to prevent high velocity projectiles from penetrating through the front face of the shield;

one or more handles affixed to the rear face of the shield adapted for an individual to grip the shield by the one or more handles in front of the torso of the individual and to carry the shield while the individual is ambulating, each handle having a length greater than its width and adapted to being encircled by an individual's hand in a power grip whereby the fingers wrap around the handle in one direction and the thumb may wrap around the handle in the other direction, the length of each handle parallel to the rear face of the shield;

a mounting assembly for mounting the shield onto a surface whereby the handles of the shield are accessible for the shield to be quickly removed from the mounting assembly, the mounting assembly comprising a seat for holding a bottom edge of the shield;

a reed switch comprising a first magnetic reed installed on the bulletproof shield and a second magnetic reed installed on the mounting assembly, whereby the switch indicates that the bulletproof shield is mounted onto the mounting assembly when the first and second magnetic reeds are in contact with one another and indicates that the bulletproof shield is removed from the mounting assembly when the first and second magnetic reeds are not in contact with one another;

a primary alarm system for alerting others to the presence of a shooter, the primary alarm system comprising a circuit having a power supply, a signal generator in operable communication with the switch and adapted to generate a signal when the switch indicates that the shield is not mounted on the mounting assembly, and at least one annunciator adapted to receive the signal from the signal generator and to communicate a shooter alert for alerting others to the presence of the shooter;

a speaker connected to an integrated circuit chip for generating an audio alert when the reed switch indicates that the bulletproof shield is not mounted on the mounting assembly; and a wire connection system connected to the primary alarm system and one or more secondary alarm systems, the wire connection system comprising a neutral wire, a hot wire to provide power to the primary and secondary alarm systems, and a signal wire for interconnecting the primary alarm system with the secondary alarm systems, wherein the signal generator is connected to the signal wire and transmits a secondary signal to the secondary alarm systems through the signal wire when the switch indicates that the shield is removed from the mounting assembly.

* * * * *